US008371221B2

(12) United States Patent
Krabbenhöft

(10) Patent No.: US 8,371,221 B2
(45) Date of Patent: Feb. 12, 2013

(54) METHOD FOR CONTROLLING THE APPLICATION OF INK IN A PRINTING PRESS AND COMPUTER PROGRAM PRODUCT FOR IMPLEMENTING THE METHOD

(75) Inventor: Uwe-Jens Krabbenhöft, Quarnbek (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 360 days.

(21) Appl. No.: 12/723,716

(22) Filed: Mar. 15, 2010

(65) Prior Publication Data

US 2010/0229744 A1 Sep. 16, 2010

(30) Foreign Application Priority Data

Mar. 13, 2009 (DE) ..... 10 2009 013 166

(51) Int. Cl.
*B41F 33/10* (2006.01)
*B41F 31/02* (2006.01)
*B41F 31/00* (2006.01)

(52) U.S. Cl. . 101/484; 101/485; 101/365; 101/DIG. 47; 101/DIG. 45

(58) Field of Classification Search ..... 101/365, 101/484, 485, DIG. 45, DIG. 47
See application file for complete search history.

(56) References Cited

U.S. PATENT DOCUMENTS

| | | | | |
|---|---|---|---|---|
| 4,975,862 | A * | 12/1990 | Keller et al. | 382/112 |
| 5,957,049 | A * | 9/1999 | Ammeter et al. | 101/211 |
| 5,967,033 | A * | 10/1999 | Pfeiffer et al. | 101/211 |
| 6,012,390 | A * | 1/2000 | Ott et al. | 101/365 |
| 6,041,708 | A * | 3/2000 | Kipphan et al. | 101/365 |
| 7,032,508 | B2 * | 4/2006 | Seymour | 101/211 |
| 7,414,755 | B2 * | 8/2008 | Ott-Heizmann et al. | 358/1.9 |
| 7,551,317 | B2 | 6/2009 | Engler et al. | |

* cited by examiner

*Primary Examiner* — Matthew G Marini
*Assistant Examiner* — Leo T Hinze
(74) *Attorney, Agent, or Firm* — Laurence A. Greenberg; Werner H. Stemer; Ralph E. Locher

(57) ABSTRACT

A method and computer program product for controlling application of ink in a printing press include predefining a setpoint color value in a device-independent color space. An ink metering element is activated with an ink application value, producing an ink layer thickness, on printing material, associated with the setpoint color value. An actual color value from the ink layer thickness on the printing material is determined, measured or colorimetrically measured in the device-independent color space. Activation with a changed ink application value based on deviation of the actual color value from the setpoint color value, produces an ink layer thickness differing from the produced ink layer thickness. A necessary ink layer thickness change is calculated based on changes in the color values in the device-independent color space upon a change in the ink layer thickness at the point of the actual color value, to determine the changed ink application value.

10 Claims, No Drawings

METHOD FOR CONTROLLING THE APPLICATION OF INK IN A PRINTING PRESS AND COMPUTER PROGRAM PRODUCT FOR IMPLEMENTING THE METHOD

CROSS-REFERENCE TO RELATED APPLICATION

This application claims the priority, under 35 U.S.C. §119, of German Patent Application DE 10 2009 013 166.3, filed Mar. 13, 2009; the prior application is herewith incorporated by reference in its entirety.

BACKGROUND OF THE INVENTION

Field of the Invention

The invention relates to a method for controlling the application of ink in a printing press, which includes the steps of predefining at least one setpoint color value in a device-independent color space, activating an ink metering element in the printing press with an ink application value in order to produce an ink layer thickness, on the printing material, which is associated with the setpoint color value, determining at least one actual color value from the ink layer thickness produced on the printing material in the device-independent color space and, in order to produce an ink layer thickness differing from the ink layer thickness produced, carrying out activation with a changed ink application value as a function of a deviation of the actual color value from the setpoint color value. The invention further relates to a computer program product for implementing all of the steps of the method according to the invention.

During printing, in particular offset printing, fluctuations in the layer thickness of the printing ink effect changes in the appearance of the printed printing material, for example the printed paper sheet. In order to achieve a printed result which corresponds to an intended image, control or regulation of the application of ink (image regulation) is commonly performed. A necessary layer thickness change corresponds to a necessary change in the application of ink, which is typically achieved through the use of a changed supply of ink. In the simplest case, density values are measured in a color measuring strip concomitantly printed onto the printing material, so that the necessary layer thickness changes can be calculated. Alternatively, individual image points (pixels) within the printing subject can also be used as measuring points.

Colorimetric evaluations which are based on spectral measurements are also widespread. For example, a procedure of that type is described in U.S. Pat. No. 6,041,708. Color deviations determined in that way are used to control the application of ink.

The objective of the image regulation is to control the layer thickness of the ink in such a way that the current print coincides with a predefinition, for example a predefined printed example. This predefinition can also be present in electronic form. Expressed in another way, the predefinition includes a distribution of device-independent color values, for example Lab values, which are color values in a visually uniform equal-interval color space. Density values as such are insufficient for image regulation inasmuch as their measured values are not meaningful in the case of overprinted colors. If, therefore, both the predefinition and the measured values of the current print are present in the form of device-independent color values, for example Lab values, then the deviations can be calculated for each image point.

SUMMARY OF THE INVENTION

It is accordingly an object of the invention to provide a method for controlling the application of ink in a printing press and a computer program product for implementing the method, which overcome the hereinafore-mentioned disadvantages of the heretofore-known methods and products of this general type and in which necessary layer thickness changes are determined for deviations that occur in color values.

With the foregoing and other objects in view there is provided, in accordance with the invention, a method for controlling the application of ink in a printing press, comprising the following steps: At least one setpoint color value is predefined in a device-independent color space. An ink metering element in the printing press is activated with an ink application value to produce an ink layer thickness, on the printing material, which is associated with the setpoint color value. At least one actual color value of the ink layer thickness produced is determined on the printing material in the device-independent color space, in particular measured, preferably colorimetrically. And in order to produce an ink layer thickness deviating from the ink layer thickness produced, activation is carried out with a changed ink application value as a function of a deviation of the actual color value from the setpoint color value. In this case, in order to determine the changed ink application value, a necessary ink layer thickness change is calculated as a function of the changes in the color values in the device-independent color space in the event of a change in the ink layer thickness at the point of the actual color value.

The changes in the color values in the device-independent color space in the event of a change in the ink layer thickness are also designated as sensitivities. In other words, sensitivities indicate how highly color values change in a device-independent color space when the layer thickness of the ink changes.

Advantageously, by using the method according to the invention, actual value control and, in a further development, actual value regulation as well, can be implemented. This is significant, in particular inasmuch as setpoint pre-definitions are frequently derived from measured data which originate from prints using a color system deviating from the printing inks used in the printing press, for example from liquid ink-based or toner-based proofs. In this case, measured data from specific variables in the device-independent color space, for example measured data about the infrared value, can be less meaningful, so that limits are placed on setpoint control.

In the method according to the invention, a plurality of measured pixels on the printing material, for example on a printed sheet, preferably all of the measured pixels, can be taken into account. The measured pixels can, in particular, also be overprints of a plurality of printing inks.

In accordance with another preferred mode of the method of the invention, the device-independent color space is the LabI color space, with I standing for the infrared component. In this case, the preferably colorimetric measurement of the at least one actual color value also preferably includes a measurement of the infrared component. When the standard colors cyan (C), magenta (M), yellow (Y) and Black (K) are used, this component is particularly influenced by the neutral color K.

In accordance with a further mode of the invention, the changes in the color values in the device-independent color space in the event of a change in the ink layer thickness can be represented by the partial derivatives of the color values in the device-independent color space with respect to the ink layer thickness. In particular, the partial derivatives can be determined numerically from an assignment of the device-dependent tonal values to the device-dependent color space.

In accordance with an added mode and practical implementation of the method of the invention, the assignment of the color values in the device-independent color space to the changes in the color values in the event of a change in the ink layer thickness can be represented as linking an assignment of the color values in the device-independent color space to tonal values in a device-dependent color space with an assignment of the tonal values in the device-dependent color space to the changes in the color values in the event of a change in the ink layer thickness.

In accordance with an additional preferred mode of the method of the invention, the ink layer thickness change dF is calculated in accordance with the formula:

$$dF=(\Delta S_i*\Delta \mathrm{Lab}I_i)/|\Delta S|\hat{}2,$$

where $\Delta S=(\partial L/\partial S, \partial a/\partial S, \partial b/\partial S, \partial I/\partial S)$ at the point $\mathrm{LabI}_{actual}$, $\Delta\mathrm{LabI}=\mathrm{LabI}_{actual}-\mathrm{LabI}_{setpoint}$, i counts off the vector components and summation is carried out over i=1, 2, 3 and 4.

As an alternative to the error ΔLabI, it is also possible to calculate with the difference ΔLab without any infrared component, that is to say also to set ΔI=0, for example. This can be the case, for example, if the setpoints are present only as Lab values. Regulation modified in this way can also be designated as proof regulation.

In accordance with yet another mode of the invention, which is particularly significant in practice, the method is used in an offset printing press. Stated in another way, the production of the ink layer thickness on the printing material takes place in an offset printing process.

In accordance with yet a further mode of the invention, which represents a first further development of the method, the method is carried out for a plurality of colors in a multicolor print. A second, additional or alternative further development resides in carrying out the method according to the invention in a plurality of physical zones, to which an ink metering element is assigned in each case. Stated in another way, this can involve a printing press having a zonal inking unit.

In accordance with yet an added or alternative mode of the method of the invention, a plurality of ink layer thickness changes can be calculated at a plurality of positions on the printing material and a mean value thereof can be determined, which is used to determine the changed ink application value.

In accordance with yet an additional mode of the method of the invention, which can also be developed further to form a regulating method: Following a change in the ink application value, for the activation of the ink metering element, at least one actual color value of the ink layer thickness produced on the printing material by the ink metering element activated with the changed ink application value is determined in the device-independent color space. Changes in the ink application value for the activation of the ink metering element are carried out until the deviation of the actual color value from the setpoint color value lies within a specific tolerance.

The calculations can be carried out in the preliminary part of a use of the method according to the invention and then stored in an ICC profile. Then, using a speed-optimized Color Management Module for each actual value of an image pixel, a control variable can advantageously be calculated for each color so that, as opposed to color measuring strip regulation, the printed result can be achieved in an overall optimal manner.

With the objects of the invention in view, there is concomitantly provided a computer program product associated with the concept of the invention. This computer program product can be loaded directly into the internal memory of a digital computer and/or stored on a computer-suitable or readable medium. According to the invention, the computer program product includes software code sections with which all of the steps of a method according to the invention can be implemented when the product runs on a computer.

The digital computer can, in particular, be a control computer of a printing press or a computer of a colorimetric measuring system for printed products from a printing press.

The method according to the invention can be used, in particular, for sheet-fed printing presses. The printing press can operate in accordance with a direct or indirect planographic printing process, in particular an offset printing process.

Other features which are considered as characteristic for the invention are set forth in the appended claims.

Although the invention is described herein as embodied in a method for controlling the application of ink in a printing press and a computer program product for implementing the method, it is nevertheless not intended to be limited to the details provided, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying example.

DETAILED DESCRIPTION OF THE INVENTION

Referring now in detail to the invention, further advantages and advantageous embodiments and developments thereof will be described below with reference to an example of calculating an ink layer thickness change.

A transformation TR1 from the device-dependent color space CMYK to the device-independent color space LabI is calculated with the aid of a color model, for example the color model used in the CPC24 module from Heidelberger Druckmaschinen AG. To this end, the CMYK space is sampled at equidistant reference points. The LabI values calculated by using the color model are stored in a table. For example, reference points are generated at 20% steps. The resultant table then has a size of 6^4*4 values. If interpolation is carried out four-dimensionally, a LabI value in the range from 0% to 100% can be calculated for each CMYK value with the aid of this table.

An inverse transformation TR2 from the device-independent color space LabI to the device-dependent color space CMYK is then calculated. For the purpose of storage in an ICC profile, the appropriate CMYK values are also calculated in this case at equidistant reference points in the LabI space. Alternatively, in an ICC profile it is also possible to use four one-dimensional input curves and output curves, so that it is also possible to sample non-equidistantly. There are various mathematical methods for the actual calculation of the inverse transformation TR2. For instance, LabI values can be looked for by variation of the CMYK values and interpolation of the values in the transformation TR1. As an alternative to this, local 4×4 matrices with appropriate weighting can be inverted. Outside of the space predefined by the LabI values of the transformation TR1, suitable interpolation must be carried out. The result is an ICC profile ICC1, which transforms from the LabI space into the CMYK space.

There follows a calculation of the transformation of the CMYK values to sensitivities ΔS. The 4×4 matrices ΔS are then calculated at equidistant reference points in the four-dimensional CMYK space. For this purpose, through the use of the color model, a LabI value (LabI_c0) is calculated from the current CMYK value. The ink layer thickness of the color C is then increased by a specific value, for example by 1%, and a LabI value (LabI_c1) is calculated. The procedure is carried out in a corresponding way for the other colors M, Y and K.

The differences (LabI_c1−LabI_c0), (LabI_m1−LabI_m0), (LabI_y1−LabI_y0), (LabI_k1−LabI_k0) are stored as a ΔS matrix. In other words, in ΔS there are the numerical partial derivatives dLabI/dS for the four colors C, M, Y and K, that is to say ∂L/∂S_c, ∂a/∂S_c, ∂b/∂S_c, ∂I/∂S_c, ∂L/∂S_m, ∂a/∂S_m, . . . In total, there are 16 values for each reference point.

In this case, it is significant that the sensitivities depend on the combination of the printing ink proportions, for example quantified as screen percentage values. The result is therefore different sensitivities for the case when a printing ink is printed on its own, for example with 40% area coverage, than for the case when at least one other color, for example two other colors, have previously also been printed at the point. Stated in another way, the sensitivities at each point in the color space (for example a four-dimensional space in the case of four printing inks) are as a rule different.

The result is an ICC profile ICC2, which assigns the sensitivities ΔS to CMYK values.

The ICC profiles ICC1 and ICC2 are calculated together using a Color Management Module, for example using that marketed by Heidelberger Druckmaschinen AG. In this case, the number of reference points can also be different, since interpolation between the reference points is carried out. The result is an ICC profile ICC_Combi, which assigns the sensitivities ΔS to LabI values.

In order to calculate a necessary layer thickness change in an ink which ensures that the ink layer thickness is changed in such a way that the desired setpoint in the LabI space is achieved, a calculation is carried out as follows for each pixel: For each actual value in the LabI space, through the use of the ICC profile ICC_Combi, the sensitivities ΔS are determined using a Color Management Module, for example using that marketed by Heidelberger Druckmaschinen AG. The color error vector 66 LabI of the actual LabI value and of the LabI setpoint is calculated. The ink layer thickness change dF for an ink for one pixel is then given by:

$$dF=(\Delta S_i*\Delta \mathrm{Lab}I_i)/|\Delta S|\hat{}2,$$

where ΔS=(∂L/∂S, ∂a/∂S, ∂b/∂S, ∂I/∂S) at the point $\mathrm{LabI}_{actual}$, ΔLabI=$\mathrm{LabI}_{actual}$−$\mathrm{LabI}_{setpoint}$, i counts off the vector components and summation is carried out over i=1, 2, 3 and 4. Stated in another way, the ink layer thickness change for a specific ink is the scalar product of the unit vector in the direction of the vector ΔS for the specific ink with the color error vector ΔLabI divided by the magnitude of the vector ΔS for the specific ink.

In a preferred embodiment, a mean ink layer thickness change is calculated by an average being calculated over a plurality of pixels or all of the pixels of the zone, for example the arithmetic mean is calculated. In this case, it is also possible to take into account diverse other weightings which increase the precision of the calculation of the necessary ink layer thickness change.

As a result of the use of ICC profiles and a Color Management Module, the sensitivities at the point of the actual values can advantageously be calculated at high speed for each pixel. The control variables for each printing ink can be determined therewith. Actual value image regulation can be implemented.

The invention claimed is:

1. A method for controlling an application of ink in a printing press, the method comprising the following steps:

predefining at least one setpoint color value in a device-independent color space;

activating an ink metering element in the printing press with an ink application value to produce, on a printing material, an ink layer thickness associated with the setpoint color value;

determining at least one actual color value of the ink layer thickness produced on the printing material in the device-independent color space;

carrying out an activation with a changed ink application value as a function of a deviation of the actual color value from the setpoint color value, to produce an ink layer thickness differing from the ink layer thickness produced;

determining the changed ink application value by calculating a necessary ink layer thickness change as a function of changes in the color values in the device-independent color space in the event of a change in the ink layer thickness at a point of the actual color value, the changes in the color values in the device-independent color space in the event of a change in the ink layer thickness being partial derivatives of the color values in the device-independent color space with respect to the ink layer thickness; and calculating the ink layer thickness change dF in accordance with a formula:

$$dF=(\Delta S_i*\Delta \mathrm{Lab}I_i)/|\Delta S|\hat{}2,$$

where ΔS=(∂L/∂S, ∂a/∂S, ∂b/∂S, ∂I/∂S) at a point $\mathrm{LabI}_{actual}$,

ΔLabI=$\mathrm{LabI}_{actual}$−$\mathrm{LabI}_{setpoint}$, i counts off vector components, and summation is carried out over i=1, 2, 3 and 4.

2. The method according to claim 1, wherein the device-independent color space is the LabI color space.

3. The method according to claim 1, which further comprises determining the partial derivatives numerically from an assignment of device-dependent tonal values to a device-dependent color space.

4. The method according to claim 1, which further comprises representing an assignment of the color values in the device-independent color space to the changes in the color values in the event of a change in the ink layer thickness as linking an assignment of the color values in the device-independent color space to tonal values in a device-dependent color space with an assignment of the tonal values in the device-dependent color space to the changes in the color values in the event of a change in the ink layer thickness.

5. The method according to claim 1, which further comprises carrying out the production of the ink layer thickness on the printing material in an offset printing process.

6. The method according to claim 1, which further comprises carrying out the method for a plurality of colors in a multicolor print.

7. The method according to claim 1, which further comprises carrying out the method in a plurality of physical zones each being associated with a respective ink metering element.

8. The method according to claim 1, which further comprises calculating a plurality of ink layer thickness changes at a plurality of positions on the printing material and determining a mean value thereof used to determine the changed ink application value.

9. The method according to claim 1, which further comprises:

following a change in the ink application value, for the activation of the ink metering element, determining at least one actual color value of the ink layer thickness produced on the printing material by the ink metering element activated with the changed ink application value in the device-independent color space; and carrying out changes in the ink application value for the activation of the ink metering element until the deviation of the actual color value from the setpoint color value lies within a specific tolerance.

10. A computer program product to be loaded directly into an internal memory of a digital computer and/or stored on a computer-suitable medium, the computer program product comprising software code sections for implementing all of the steps of the method according to claim 1 when the product runs on the computer.

* * * * *